US008500235B2

(12) United States Patent
Usuda

(10) Patent No.: US 8,500,235 B2
(45) Date of Patent: Aug. 6, 2013

(54) RECORDING APPARATUS

(75) Inventor: Hidenori Usuda, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/441,343

(22) Filed: Apr. 6, 2012

(65) Prior Publication Data

US 2012/0256997 A1 Oct. 11, 2012

(30) Foreign Application Priority Data

Apr. 11, 2011 (JP) ..... 2011-087542

(51) Int. Cl.
*B41J 29/393* (2006.01)
*B41J 2/01* (2006.01)

(52) U.S. Cl.
USPC ..... 347/19; 347/102

(58) Field of Classification Search
USPC ..... 347/9, 14, 19, 23, 44, 47, 100, 102, 347/106, 238
See application file for complete search history.

(56) References Cited

U.S. PATENT DOCUMENTS

| | | | | |
|---|---|---|---|---|
| 6,783,227 | B2 | 8/2004 | Suzuki et al. | |
| 7,393,095 | B2 | 7/2008 | Oshima et al. | |
| 7,690,782 | B2 * | 4/2010 | Odell | 347/102 |
| 2012/0139993 | A1 * | 6/2012 | Yamada et al. | 347/19 |

FOREIGN PATENT DOCUMENTS

| | | |
|---|---|---|
| JP | 2004-314304 | 11/2004 |
| JP | 2005-104108 | 4/2005 |

* cited by examiner

*Primary Examiner* — Hai C Pham
(74) *Attorney, Agent, or Firm* — Workman Nydegger

(57) ABSTRACT

A recording apparatus includes a transportation mechanism that transports a recording material, a recording head that discharges photoactive liquids, a light irradiation section that irradiates the discharged photoactive liquids with light, and a failure detection section that detects failure of light emitting devices in the light irradiation section. This recording apparatus executes recording by masking a nozzle opening which corresponds to a failed light emitting device, when the failure detection section detects the failure.

4 Claims, 7 Drawing Sheets

RECORDING APPARATUS

BACKGROUND

1. Technical Field

The present invention relates to a recording apparatus that includes a transportation mechanism that transports a recording material, a recording head that reciprocates in a direction intersecting the transporting direction of the recording material, and a light irradiation section. The recording head has a nozzle row that discharges photoactive liquids onto the recording material being transported. The light irradiation section has a light emitting device row that irradiates the discharged photoactive liquids with light in order to chemically change the liquids. The light emitting device row and the nozzle row extend in the same direction.

2. Related Art

To date, recording apparatuses that include a recording head and a light irradiation section have been developed, as disclosed in JP-A-2005-104108 and JP-A-2004-314304. In such a recording apparatus, the recording head has a nozzle row where many nozzle openings are arranged that discharging light-curable inks (for example, ultraviolet (UV) curable inks) onto the recording surface of a recording material (hereinafter, also referred to as "paper"). In addition, the light irradiation section has a light emitting device row where multiple light emitting devices (for example, light emitting diodes (LEDs)) are arranged that irradiates the discharged light-curable inks with light in order to cure the inks.

In a recording apparatus having a carriage to which a recording head is attached and which reciprocates in a direction intersecting a transporting direction of paper, two light emitting device rows are arranged on respective sides of nozzle rows having various color inks, in order to irradiate light-curable inks with light upon both the forward and backward movements of the recording head, as described in the above-mentioned patent documents.

In the above recording apparatus, if one of the light emitting devices, such as LEDs, constituting the light emitting device row fails during a recording process, light-curable inks discharged from several tens of nozzle openings that correspond to the failed light emitting device are left uncured. In this case, a useless printed material having no commercial value may be produced.

Neither of the above-mentioned documents describes any measures against the failure of a light emitting device as described above. In consideration of a current market for available materials printed with light-curable inks, taking measures against the failure of a light emitting device has become an important issue.

Accordingly, it is desirable to be able to continue recording without leaving light-curable inks uncured, even if some light emitting devices fail.

SUMMARY

An advantage of some aspects of the invention is to provide a recording apparatus that is capable of continuing recording, even if some light emitting devices constituting a light irradiation section fail.

According to an aspect of the invention, a recording apparatus includes: a transportation mechanism that transports a recording material; a recording head that reciprocates in a direction intersecting a transporting direction of the recording material and that has a nozzle row discharging photoactive liquids onto the recording material being transported; a light irradiation section that has a light emitting device row where a plurality of light emitting devices are arranged in an extending direction of the nozzle row, wherein the light emitting devices chemically change the photoactive liquids by irradiating the discharged photoactive liquids with light; a failure detection section that detects failure of the light emitting devices constituting the light emitting device row; and a control section that controls respective operations of the transportation mechanism, the recording head, and the light irradiation section. Furthermore, the control section has a failure event mode into which the control section goes when the failure detection section detects failure of at least one of the light emitting devices, and the failure event mode is configured to execute recording by masking at least one of nozzle openings constituting the nozzle row which corresponds to the failed light emitting device.

The term "light" used herein may refer to visible light that typically has a wavelength of 360 nm or 400 nm to 760 nm or 830 nm, ultraviolet light that has a wavelength shorter than the visible light, namely, a wavelength of approximately 1 nm to 380 nm, or infrared light that has a wavelength longer than the visible light, namely, a wavelength of approximately 780 nm to 1 mm. Furthermore, the above light may be an electromagnetic wave that has a wavelength shorter than the ultraviolet light or longer than the infrared light. Therefore, it is preferable that the term "light" be broadly interpreted, for the purpose of simplifying the following explanation.

Likewise, the term "photoactive liquid" used herein refers to various liquids that are chemically changed by reacting with typical light including visible light, ultraviolet light, and infrared light. In addition, the above light may be an electromagnetic wave that has a wavelength shorter or longer than the typical light, for the purpose of simplifying the following explanation.

In the recording apparatus according to this aspect, the failure event mode, into which the control section goes when the failure detection section detects failure of at least one of the light emitting devices, is configured to execute the recording by masking at least one of the nozzle openings constituting the nozzle row in the recording head which corresponds to the failed light emitting device. Accordingly, the nozzle opening that is responsible for the failed light emitting device does not discharge a photoactive liquid. Consequently, even if continuing recording upon failure of any of the light emitting devices, the light emitting device can execute the recording without leaving a photoactive liquid uncured.

In the recording apparatus according to this aspect, it is preferable that the control section change an amount by which the transportation mechanism feeds the transportation material during a subsequent recording operation, at a location where a photoactive liquid should be discharged from the masked nozzle opening. In addition, it is preferable that the recording be executed while the unmasked nozzle openings and this location are aligned.

The above recording apparatus executes the recording while masking the nozzle opening corresponding to the failed light emitting device. Accordingly, due to this masking, there is a location at which a photoactive liquid is not discharged. However, the control section changes an amount by which the transportation mechanism feeds the recording material during a subsequent recording operation and, then executes the recording while the unmasked nozzle openings and the above location are aligned. This enables the recording to be executed without causing the deficiency of discharged photoactive liquids.

In this case, since the light emitting devices that are responsible for the unmasked nozzle openings are not defective, the photoactive liquids discharged from the unmasked nozzle openings are irradiated with the light, and then, are cured.

It is preferable that the recording apparatus according to this aspect be configured to execute the recording by means of a recording method employing at least one of band feeding recording and high resolution recording. In addition, it is preferable that the control section have an alternate recording mode in advance, in which the recording method that has been used prior to an occurrence of the failure is continued to be used by using all or some of the unmasked nozzle openings while the nozzle opening that corresponds to the failed light emitting device is masked.

The above recording apparatus has the alternate recording mode, in order to deal with possible failure of the light emitting devices. This alternate recording mode makes it possible to continue to use the recording method that has been performed prior to an occurrence of the failure, by using all or some of the unmasked nozzle openings. Consequently, it is possible for the control section to go into the failure event mode, immediately after one or more of the light emitting devices fail, and to continue the recording.

In the recording apparatus according to this aspect, it is preferable that the light emitting device row in the light irradiation section include a plurality of light emitting device rows.

As described above, the light emitting device row in the light irradiation section includes the multiple light emitting device rows.

When the light emitting devices in all the light emitting device rows are turned on and are used, the total irradiation intensity of the light emitted from all the light emitting devices may simply be high enough to chemically change the photoactive liquids. Accordingly, the light irradiation intensity of each light emitting device in one of the light emitting device rows may be set to be lower than that of a typical recording apparatus provided with a single light emitting device row. This enables the load of the light emitting devices upon emitting to be lightened, so that the risk of the failure of the light emitting devices is decreased.

Moreover, the light emitting devices in all the light emitting device rows may not be turned on. Instead, the light emitting devices in one or some of the light emitting device rows may be turned on.

In this case, the light irradiation intensity of one of the light emitting devices is higher than that when all the light emitting device rows are used, but still may be set to be lower than that of a typical recording apparatus provided with a single light emitting device row. In addition, the selected light emitting device row or rows to be turned on may be exchanged, for each irradiation or every regular period. This decreases the frequency of using or lighting of the light emitting devices, thereby lightening the load of the light emitting devices upon emitting, as well as decreasing the risk of the failure thereof.

In the above aspect, an example of the photoactive liquid is an ultraviolet (UV) curable ink, and an example of light emitting device is a light emitting diode (LED) for emitting an ultraviolet (UV) ray.

BRIEF DESCRIPTION OF THE DRAWINGS

The invention will be described with reference to the accompanying drawings, wherein like numbers reference like elements.

DESCRIPTION OF EXEMPLARY EMBODIMENTS

A specific description will be given below of a structure and function of a recording apparatus 1 according to embodiments of the invention, with reference to FIGS. 1 to 7.

Thereinafter, first, a basic structure of a recording apparatus 1 according to embodiments of the invention will be described on the basis of FIGS. 1 and 2. Then, a characteristic structure thereof will be described on the basis of the embodiments of the invention.

Embodiment (Refer to FIGS. 1 to 7)

Figure 1:
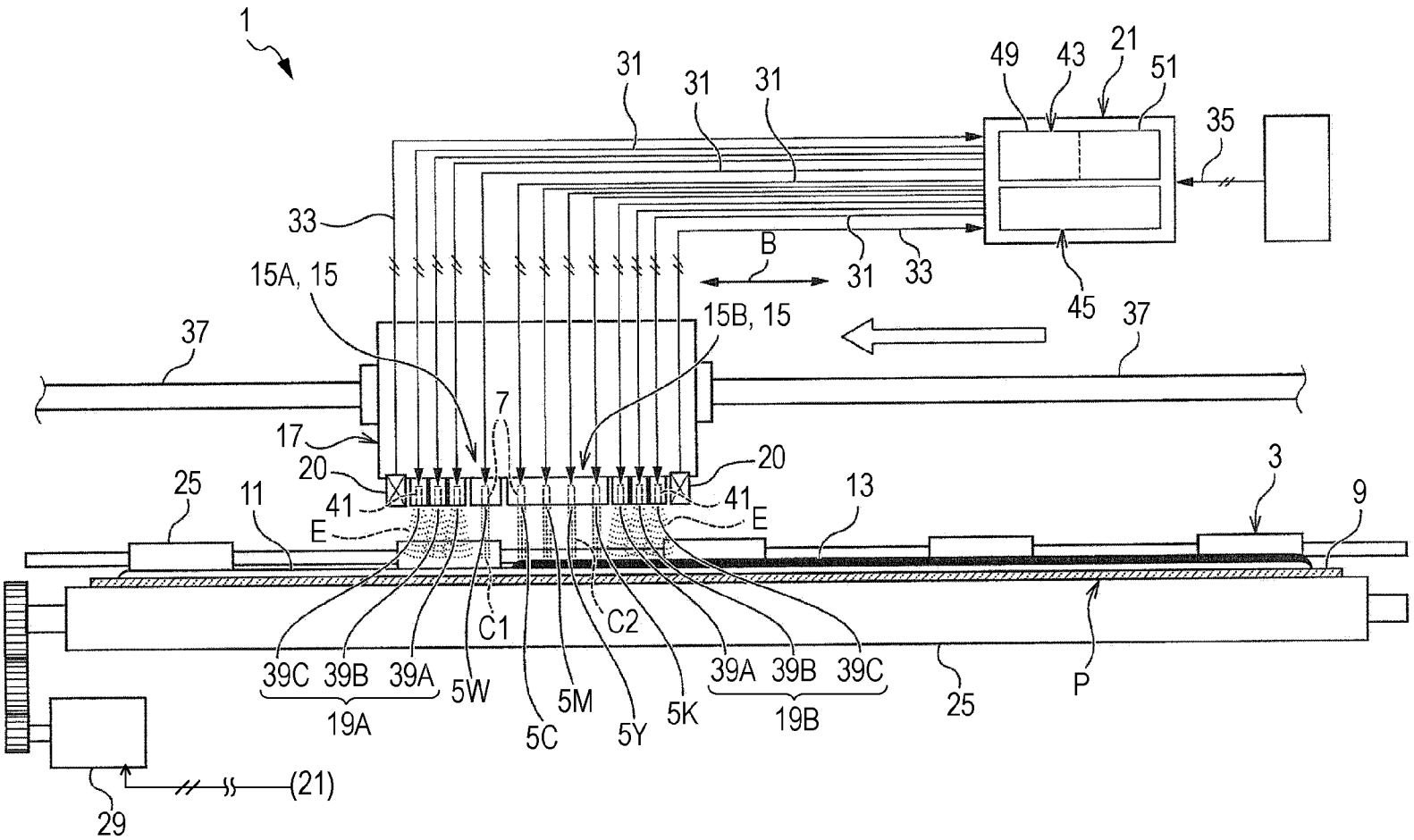
FIG. 1 is a front view schematically depicting a main part of an internal structure of a recording apparatus according to an embodiment of the invention.

A recording apparatus 1 shown in FIG. 1 is an ink jet printer 1 that enables band feeding recording. Note that the reference numeral of the recording apparatus is also given to the ink jet printer, and band feeding recording is also referred to as "band feeding printing". This ink jet printer 1 includes a transportation mechanism 3, a recording head unit 15, light irradiation sections 19A and 19B, failure detection sections 20 and 20, and a control section 21. Specifically, the transportation mechanism 3 transports a recording material P in a transporting direction A. The recording head unit 15 has nozzle rows 5W, 5C, 5M, 5Y and 5K that discharge photoactive liquids C1 and C2 onto the recording material P being transported, and reciprocates in a direction B intersecting the transporting direction A. Each of the light irradiation sections 19A and 19B has light emitting device rows 39A, 39B and 39C, and each light emitting device row has light emitting devices 41 aligned in an extending direction of the nozzle rows 5W, 5C, 5M, 5Y and 5K. The light emitting devices 41 irradiate the discharged photoactive liquids C1 and C2 with light E, in order to chemically change the liquids C1 and C2. The failure detection section 20 detects failure of the light emitting devices 41 constituting the light emitting device rows 39A, 39B and 39C. The control section 21 controls the respective operations of the transportation mechanism 3, the recording head unit 15, and the light irradiation sections 19A and 19B.

Furthermore, the control section 21 has a failure event mode 45 into which the control section 21 goes when the failure detection section 20 detects failure of at least one of the light emitting devices 41. This failure event mode 45 is configured to enable recording by masking some of the nozzle openings 7 constituting the nozzle rows 5W, 5C, 5M, 5Y and 5K which correspond to the failed light emitting device 41, when one of the light emitting devices 41 fails. In this embodiment, the light emitting device rows 39A, 39B and 39C are arranged in each of the light irradiation sections 19A and 19B.

In more detail, the ink jet printer 1 includes the transportation mechanism 3 that can transport the paper P intermittently in the transporting direction A by a predetermined band feeding amount D, and the nozzle rows 5W, 5C, 5M, 5Y and 5K, each of which has the nozzle openings 7 aligned in the transporting direction A. These nozzle rows 5W, 5C, 5M, 5Y and 5K are arranged in the direction B intersecting the transporting direction A. Furthermore, the ink jet printer 1 includes the recording head unit 15 which forms desired substrates 11 and images 13 on a recording surface 9 of the paper P with ultraviolet (UV) curable inks C1 and C2, which are an example of photoactive liquids, discharged from the nozzle openings 7 constituting the nozzle rows 5W, 5C, 5M, 5Y and 5K.

Herein, the term "band" refers to a recording execution region having a length in the transporting direction A, which corresponds to a whole length of the nozzle rows 5W, 5C, 5M, 5Y and 5K in the transporting direction A of the recording material P, or a product having the above recording execution region.

In addition, the term "band feeding amount" refers to a feeding amount by which the recording material P is actually transported whenever recording is executed for each band.

Moreover, the ink jet printer 1 includes a carriage 17 and the light irradiation sections 19A and 19B. The carriage 17 is provided with the recording head unit 15, and reciprocates in the intersecting direction B. The light irradiation sections 19A and 19B are attached to the carriage 17, so as to be arranged on the respective sides of the recording head unit 15 in the intersecting direction B. Each of the light irradiation sections 19A and 19B includes the light emitting device rows 39A, 39B and 39C. Each of the light emitting device rows 39A, 39B and 39C is formed of multiple light emitting diodes 41 (also referred to as "LEDs"), which are an example of the light emitting devices, and the LEDs 41 irradiate the ultraviolet (UV) curable inks C1 and C2 discharged from the nozzle openings 7 with ultraviolet rays (UV light) E, which is an example of the light E for chemically changing (for example, curing) the inks C1 and C2.

The light emitting device rows 39A, 39B and 39C are arranged in the direction B intersecting the transporting direction A of the paper P. Details of this will be described later.

In addition, an ultraviolet ray (UV light) emitted from one of the LEDs 41 constituting the light emitting device rows 39A, 39B and 39C are used to cure multiple ultraviolet (UV) curable inks discharged individually from some of the nozzle openings 7 constituting the nozzle rows 5W, 5C, 5M, 5Y and 5K.

In this embodiment, an ultraviolet ray (UV light) E emitted from a single LED 41 cures ultraviolet (UV) curable inks discharged from approximately thirty six nozzle openings 7 at the same time.

Figure 2:
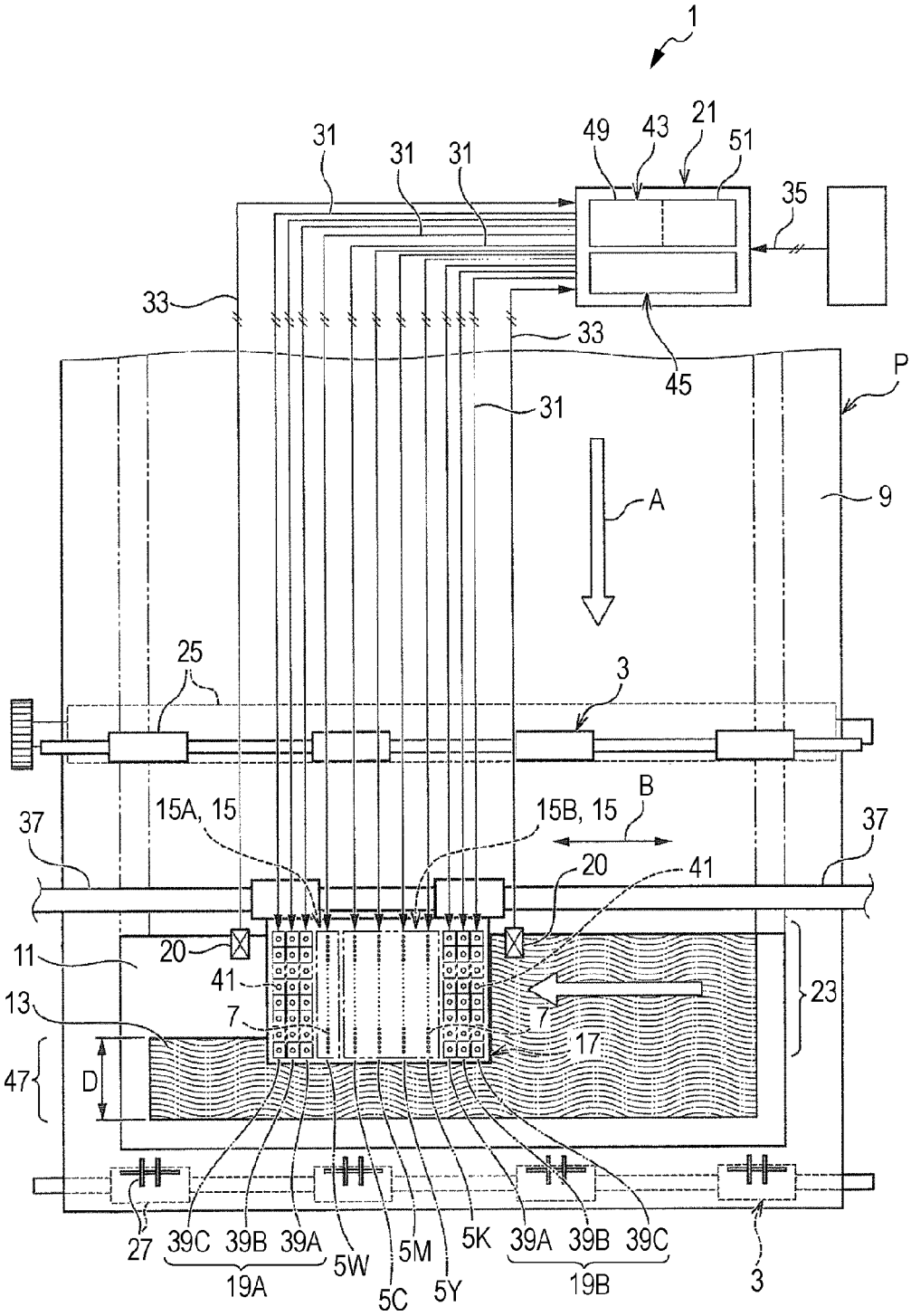
FIG. 2 is a plan view depicting the main part of the schematic internal structure of the recording apparatus according to the embodiment of the invention.

As shown in FIGS. 1 and 2, the transportation mechanism 3 includes, for example, a transporting roller unit 25 composed of a pair of nip rollers disposed upstream of the recording execution region 23, and an ejection roller unit 27 composed of a pair of nip rollers disposed downstream of the recording execution region 23.

Both the transporting roller unit 25 and the ejection roller unit 27 are driven by a motor 29. This motor 29 feeds the paper P intermittently by the band feeding amount D, in response to a signal 31 for instructing the transportation of the paper P by the band feeding amount D which is transmitted from the control section 21 (described later).

In this embodiment, the recording head unit 15 includes two types of heads, namely, a first recording head 15A that discharges the inks C1 for substrates, and a second recording head 15B that discharges the inks C2 for forming images. For example, the first recording head 15A is disposed on the left side in FIG. 1 or 2, whereas the second recording head 15B is disposed on the right side in FIG. 1 or 2.

The first recording head 15A is provided with the nozzle row 5W that discharges the inks C1 of, for example, white (W), gold (G), silver (S), etc., for substrates. Meanwhile, the second recording head 15B is provided with the nozzle rows 5C, 5M, 5Y and 5K that discharge the inks C2 of, for example, cyan (C), magenta (M), yellow (Y), and black (B), for forming images. In addition, the nozzle rows 5C, 5M, 5Y and 5K are arranged at predetermined intervals in the intersecting direction B.

The control section 21 (described later) transmits, to the nozzle rows 5W, 5C, 5M, 5Y and 5K, signals 32 for instructing a discharging amount of an ink which corresponds to a location of each of the nozzle openings 7. With these signals, the discharging amounts of the inks are adjusted.

Note that the inks C1 and C2 discharged from the nozzle openings 7 of the nozzle rows 5W, 5C, 5M, 5Y and 5K in the ink jet printer 1 are ultraviolet (UV) curable inks, which are to be cured by being exposed to the irradiation of the ultraviolet rays (UV light) E, as described above.

The term "UV ink" refers to an ink that is to be cured and fixed excellently rapidly by being exposed to the irradiation of the UV light (ultraviolet rays) E, and a volume shrinkage ratio upon curing of this ink is much lower than that of known inks that are to be cured and fixed by a heater evaporating a solvent.

Moreover, since they do not contain any solvent components, UV inks are safe for the environment. In addition, UV inks are cured rapidly by being exposed to the irradiation of the UV light (ultraviolet ray) E. Therefore, UV inks are suitable for a film-based material having a low ink absorption ability, such as the recording material P.

The carriage 17 is a reciprocating transportation mechanism that reciprocates the recording head unit 15 along a carriage guide axis 37 extending in the intersecting direction B.

This carriage 17 is supplied with power for reciprocating the carriage 17 from a motor (not shown). This motor can rotate in the forward or reverse direction and control the feeding of the carriage 17 precisely in multiple steps. Specifically, the rotation power of this motor is transmitted to the carriage 17 through a toothed belt.

The first light irradiation section 19A that cures the inks C1 for substrates is disposed, for example, on the left side in FIG. 1 or 2, whereas the second light irradiation section 19B that cures the inks C2 for forming images is disposed, for example, on the right side in FIG. 1 or 2.

In the ink jet printer 1 shown in FIGS. 1 and 2, the light irradiation sections 19A and 19B irradiate the ultraviolet (UV) curable inks C1 and C2, which have been discharged onto the recording surface 9 of the paper P, with the ultraviolet rays (UV light) E having a predetermined intensity, thereby curing and fixing the ultraviolet (UV) curable inks C1 and C2.

In this embodiment, each of the light irradiation sections 19A and 19B includes the light emitting device rows 39A, 39B and 39C. Each of the light emitting device rows 39A, 39B and 39C is provided with the LEDs 41, which are arranged corresponding to the arrangement of the nozzle openings 7 in the nozzle rows 5W, 5C, 5M, 5Y and 5K of the recording heads 15A and 15B.

The control section 21 (described later) transmits, to the LEDs 41, signals 31 for instructing the executing or stopping of the irradiation of the ultraviolet ray (UV light) E and the irradiation intensity thereof corresponding to the location of each LED 41. With these signals 31, the irradiation of the ultraviolet rays (UV light) E is executed or stopped, and the irradiation intensity thereof is adjusted.

The above-described ink jet printer 1 of the embodiment includes the failure detection sections 20 and 20, and the control section 21, in addition to the above-described components. The failure detection sections 20 and 20 detect the failure of the LEDs 41 constituting the light emitting device rows 39A, 39B and 39C. The control section 21 switches between a normal mode 43 and the failure event mode 45 in which the recording heads 15A and 15B and the light irradiation sections 19A and 19B are to operate, on the basis of failure detection information 33 from the failure detection sections 20 and 20 and preset setting information 35. Then, the control section 21 causes the recording heads 15A and 15B and the light irradiation sections 19A and 19B to operate in the switched mode.

The failure detection section 20 may employ, for example, a mechanism that senses the operating temperature of each LED 41 or a variation in a voltage of a circuit in order to check each LED 41, and discriminates between the normal and abnormal (or defective) operations of each LED 41, on the basis of the sensed result.

The control section 21 switches between the operations of the recording heads 15A and 15B and between the light irradiation sections 19A and 19B as appropriate, depending on a moving direction of the carriage 17. In addition, the control section 21 causes the selected recording head and light irradiation section to selectively operate in one of the normal mode 43 and the failure event mode 45.

The normal mode 43 can be used by switching between an all in-use mode 49 and a partially in-use mode 51, in accordance with a user's selection. In the all in-use mode 49, all the light emitting device rows 39A, 39B and 39C are used, whereas in the partially in-use mode 51, one or two of the light emitting device rows 39A, 39B and 39C are used.

In the all in-use mode 49, the light irradiation sections 19A and 19B are switched, depending on whether the carriage 17 scans in the forward or reverse direction. Furthermore, in the all in-use mode 49, all the LEDs 41 constituting the light emitting device rows 39A, 39B, 39C in one of the light irradiation sections 19A and 19B in use turn on, and perform the irradiation of the ultraviolet rays (UV light) E.

Meanwhile, in the partially in-use mode 51, the light irradiation sections 19A and 19B are switched, depending on a scanning direction of the carriage 17. Furthermore, one or two light emitting devices are selected among the light emitting device rows 39A, 39B and 39C in one of the light irradiation sections 19A and 19B in use. Following this, the selected rows are exchanged for each irradiation or every regular period. Finally, LEDs 41 on the selected light emitting device row or rows turn on, whereas the LEDs 41 in the other light emitting device rows or row turn off, and then, the active LEDs 41 performs the irradiation of the ultraviolet rays (UV light) E.

The selection of one or two light emitting device rows among the light emitting device rows 39A, 39B and 39C may be made regularly, on the basis of the total numbers of lightings of the light emitting device rows 39A, 39B and 39C or the total lighting periods thereof, or may be made randomly.

As described above, the failure event mode 45 makes it possible to execute recording while masking some of the nozzle openings 7 constituting the nozzle rows 5W, 5C, 5M, 5Y and 5K which correspond to a failed light emitting device 41. Moreover, in this embodiment, if an auxiliary light emitting device row is available, when the failure of one of the LEDs 41 in the light emitting device rows 39A, 39B and 39C is detected, the failure event mode 45 may stop using the light emitting device row having the failed LED 41, and may use a light emitting device row having no defective LEDs 41, instead of the light emitting device row having the failed LED 42.

Figure 3:
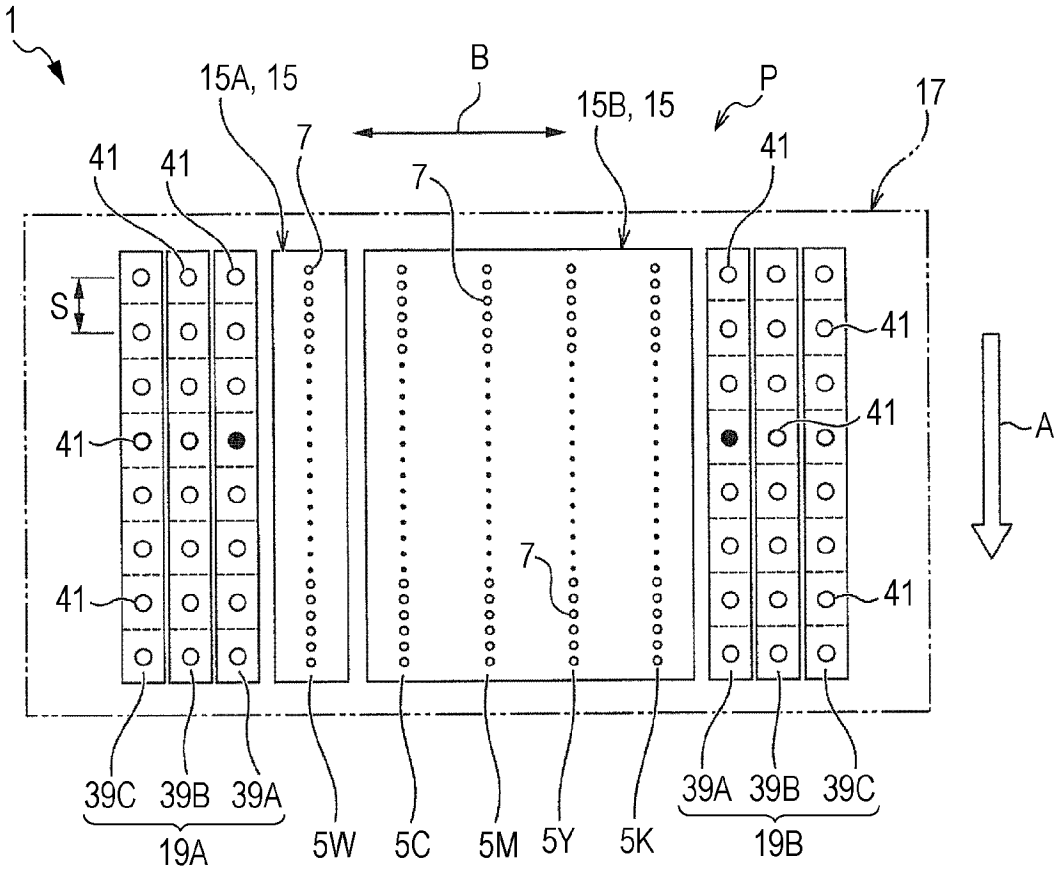
FIG. 3 is a schematically enlarged view depicting light emitting device rows in the recording apparatus according to the embodiment of the invention.

Furthermore, in this embodiment, as shown in FIG. 3, the LEDs 41 of each of the light emitting device rows 39A, 39B and 39C are placed at regular intervals S in the transporting direction A of the paper P. In addition, the respective, corresponding LEDs 41 of the light emitting device rows 39A, 39B and 39C are placed at the same position in the transporting direction A.

Accordingly, when an LED 41 in one of the light emitting device rows 39A, 39B and 39C fails, an LED 41 in another one of the light emitting device rows 39A, 39B and 39C, which is located at the same position as the failed LED 41 in the transporting direction A, operates to make up for the shortage of the light irradiation intensity due to the failed LED 41.

Therefore, even if an LED 41 in one of the light emitting device rows 39A, 39B and 39C fails, one or more LEDs 41 of another row or the other rows, which are located at the same position as the failed LED 41 in the transporting direction A, make up for the shortage of the light irradiation intensity due to the failed LED 41. This enables the desired ultraviolet (UV) curable inks C1 and C2 to be cured by means of the irradiation of the ultraviolet rays (UV light) E having the compensated intensity.

Next, a specific description will be given of an operation flow of the ink jet printer 1 according to this embodiment, with reference to flowcharts shown in FIGS. 4 and 5. Note that the following description is given by breaking down an operation of the ink jet printer 1 into those in the normal and failure event modes.

Figure 4:
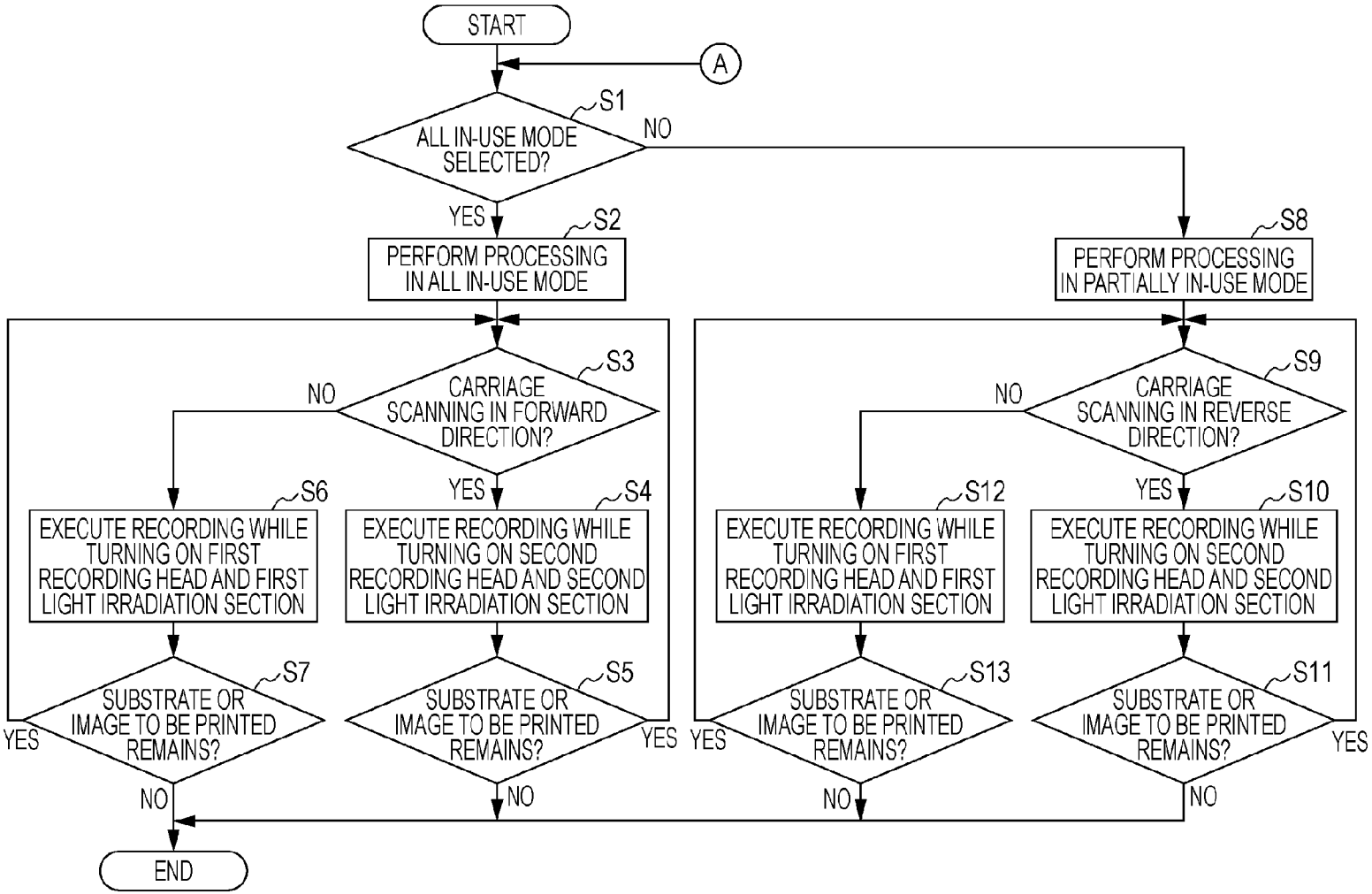
FIG. 4 is a flowchart depicting an operation in a normal mode of the recording apparatus according to the embodiment of the invention.

Operation in Normal Mode (Refer to FIG. 4)

In this embodiment, when none of the LEDs 41 fails, the control section 21 selects the normal mode 43 shown in FIG. 4. At a step S1, first, the control section 21 determines which of the all in-use mode 49 and the partially in-use mode 51 has been selected. If it is determined that the all in-use mode 49 has been selected, the processing proceeds to a step S2, and recording is to be executed in the all in-use mode 49.

Upon operation in the all in-use mode 49, the total irradiation intensity of the light E that is emitted from all the LEDs 41 in the light emitting device rows 39A, 39B and 39C may simply be high enough to chemically change the photoactive liquids. Accordingly, the light irradiation intensity of each LED 41 in one of the light emitting device rows 39A, 39B and 39C may be set to be lower than that of a typical recording apparatus provided with a single light emitting device row. This enables the load of the LEDs 41 upon emitting to be lightened, so that the risk of the failure of the LEDs 41 is decreased.

Next, the processing proceeds to a step S3, and the control section 21 determines whether the moving (or scanning) direction of the carriage 17 is forward or reverse. If it is determined that the moving direction of the carriage 17 is forward, the processing proceeds to a step S4. Then, the control section 21 executes recording while turning on the second recording head 15B and the second light irradiation section 19B and turning off the first recording head 15A and the first light irradiation section 19A.

Next, the recording processing proceeds to a step S5, and the control section 21 determines whether or not any substrate 11 or image 13 to be printed remains. If it is determined that no substrate 11 or image 13 to be printed remains, the control section 21 terminates the processing.

Meanwhile, if it is determined that any substrate 11 or image 13 to be printed remains at the step S5, the processing returns to the step S3. Then, the control section 21 repeats the determinations and operation of the steps S3 to S5.

On the other hand, if it is determined that the moving direction of the carriage 17 is reverse at the step S3, the recording processing proceeds to a step S6. Then, the control section 21 executes recording while turning on the first recording head 15A and the first light irradiation section 19A and turning off the second recording head 15B and the second light irradiation section 19B.

Then, the recording processing proceeds to a step S7, and the control section 21 determines whether or not any substrate 11 or image 13 to be printed remains. If it is determined that no substrate 11 or image 13 to be printed remains, the control section 21 terminates the processing.

Meanwhile, if any substrate 11 or image 13 to be printed is determined to remain at the step S7, the processing returns to the step S3. Then, the control section 21 repeats the determinations and operations of the steps S3, S6 and S7 or the determinations and operations of the steps S3 to S5.

On the other hand, it is determined that the partially in-use mode 51 is selected at the step S1, the processing proceeds to a step S8. Then, the control section 21 executes processing while switching between the light emitting device rows 39A, 39B and 39C to be used, as appropriate, in accordance with the preset setting information 35.

In this case, the light irradiation intensity of one LED 41 is higher than that when all the light emitting device rows 39A, 39B and 39C are used, but still may be set to be lower than that of a typical recording apparatus provided with a single light emitting device row. In addition, the selected light emitting device rows for emitting the light E are exchanged for each irradiation. This decreases the frequency of using or lighting of the LEDs 41, thereby lightening the load of the LEDs 41 upon emitting, as well as decreasing the risk of the failure of the LEDs 41.

In this embodiment, the respective, corresponding LEDs 41 in the light emitting device rows 39A, 39B and 39C are placed at the same position in the extending direction of the nozzle rows 5W, 5C, 5M, 5Y and 5K. Accordingly, even if the selected light emitting device rows for emitting the light E are exchanged for each irradiation, the total light irradiation intensity of the light E applied to the photoactive liquids is not changed. This prevents the variation in the recording quality.

Thereafter, the control section 21 performs determinations and operations of steps S9 to S13 which are the same as those in the steps S3 to S7, respectively. Then, if it is determined that no substrate 11 or image 13 to be printed remains at the step S11 or S13, the control section 21 terminates the processing.

Figure 5:
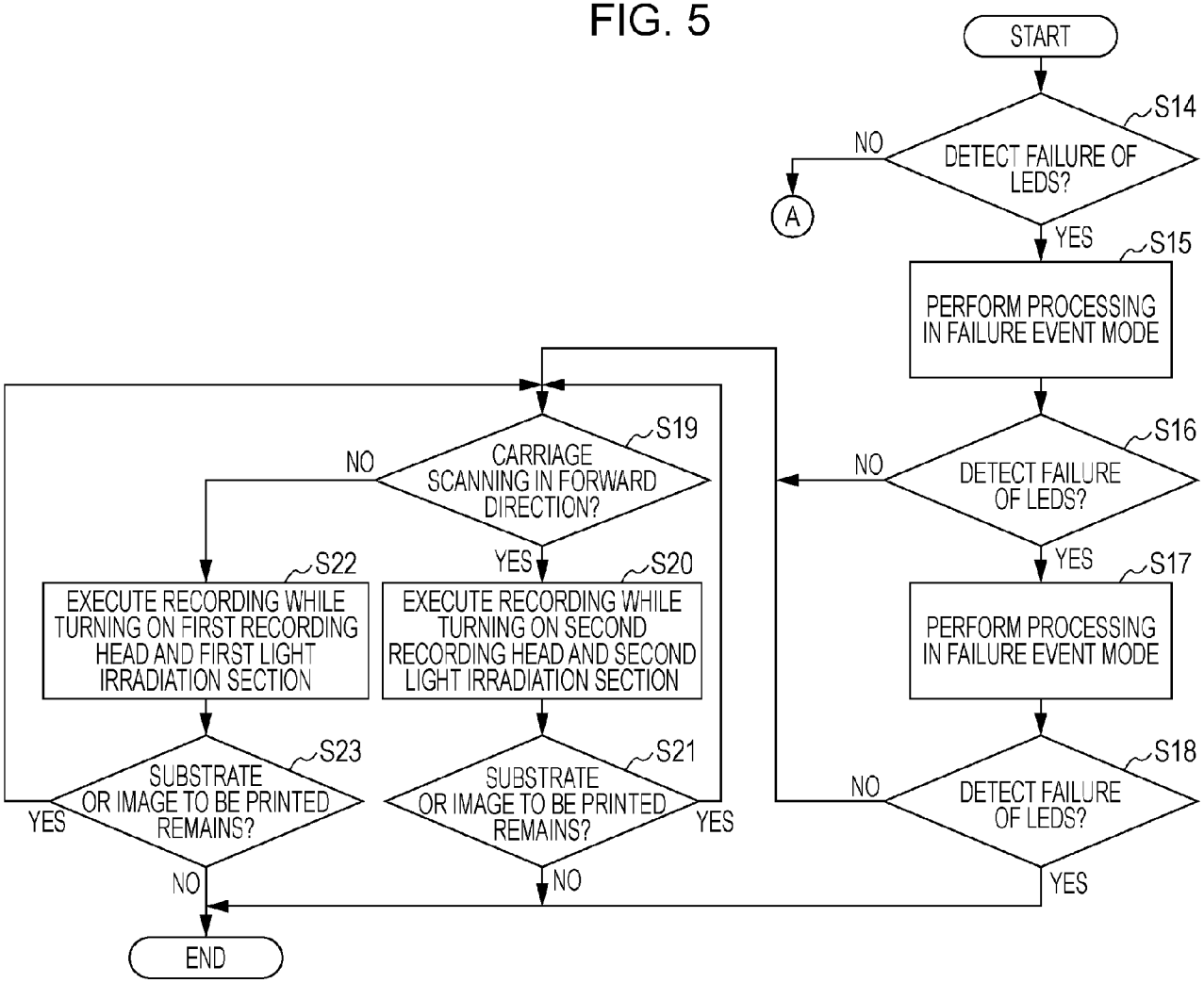
FIG. 5 is a flowchart depicting an operation in a failure event mode of the recording apparatus according to the embodiment of the invention.
Figure 6:
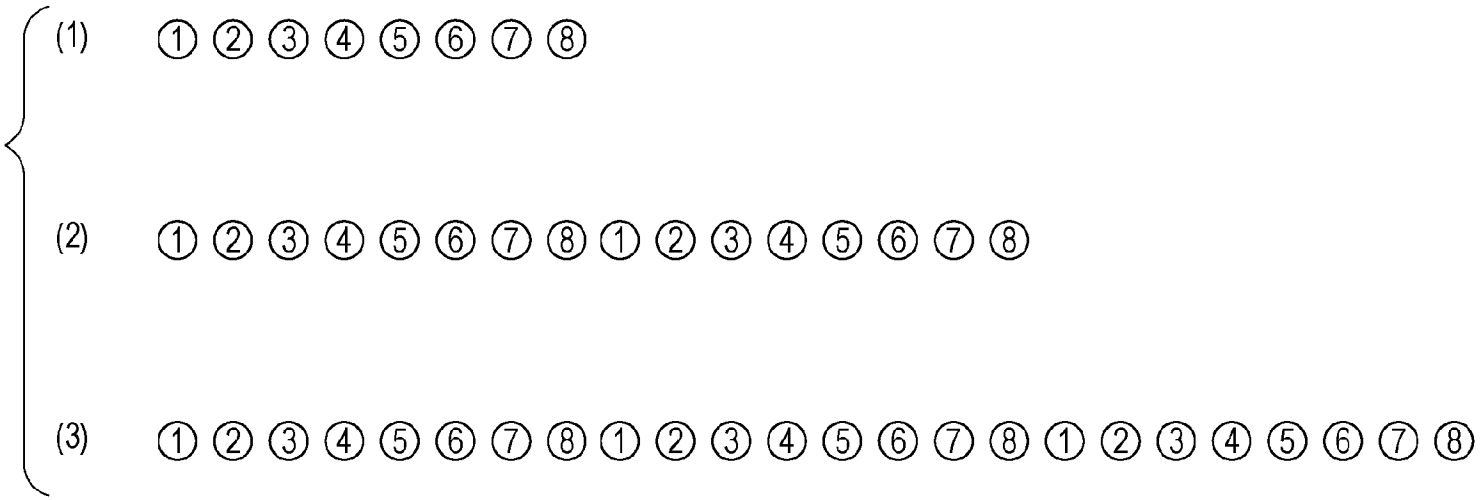
FIG. 6 is a view for explaining a function and effect of the recording apparatus according to the embodiment of the invention, when the recording apparatus operates in the normal mode.
Figure 7:
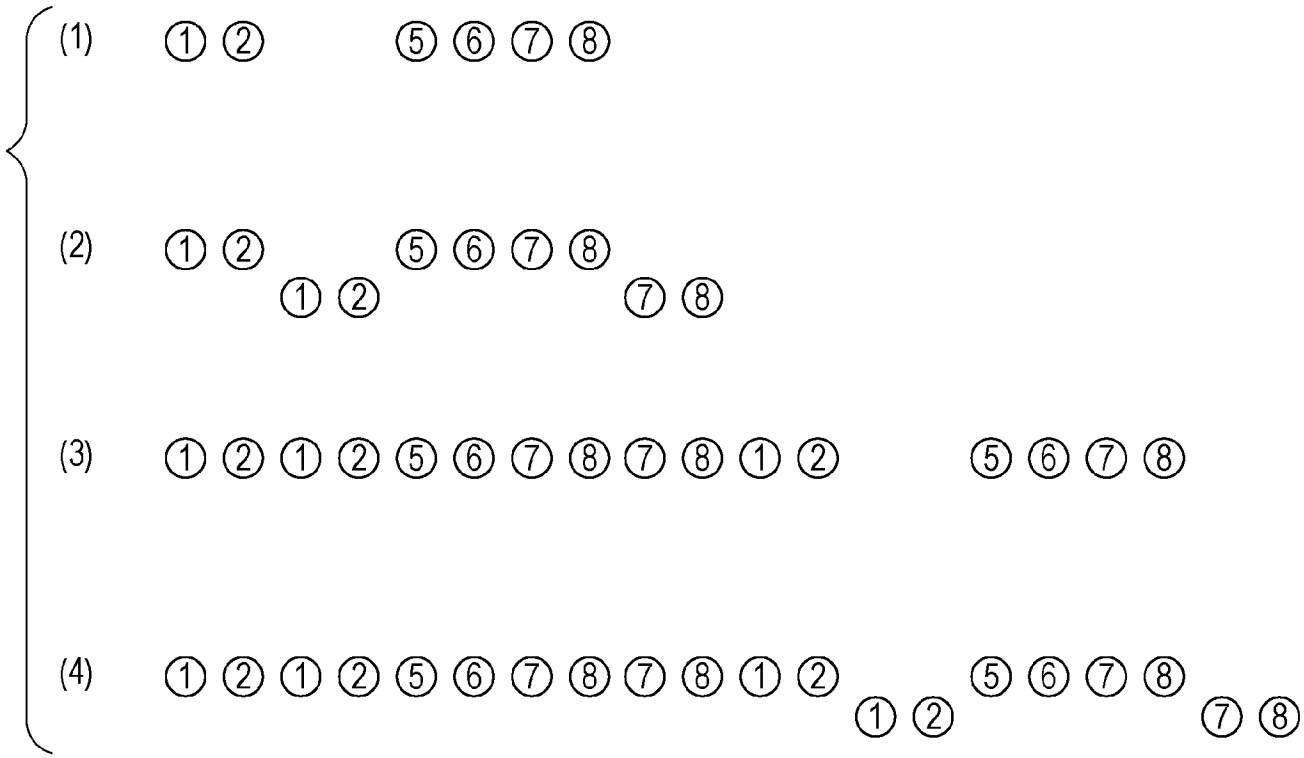
FIG. 7 is a view for explaining a function and effect of the recording apparatus according to the embodiment of the invention, when the recording apparatus operates in the failure event mode.

Operation in Failure Event Mode (Refer to FIG. 5)

At a step S14, first, the control section 21 makes a determination whether to have received failure detection information 33 from the failure detection section 20. If it is determined that the failure detection section 20 has detected the failure of any of the LEDs 41, the processing proceeds to an operation in the failure event mode at a step S15. In this failure event mode, if an auxiliary light emitting device row is available, the control section 21 executes recording while replacing the light emitting device row having the failed LED 41 with another one. Note that a description will be given later of an operation when no auxiliary light emitting device row is available.

Subsequently, the processing proceeds to a step S16, and the control section 21 makes a second determination whether to have received failure detection information 33 from the failure detection section 20.

If it is determined that the failure detection section 20 has detected the failure of any of the LEDs 41, the recording processing proceeds to a step S17. Then, the control section 21 executes recording while replacing the light emitting device row having the failed LED 41 with the remaining one.

Next, the processing proceeds to a step S18, the control section 21 makes a third determination whether to have received failure detection information 33 from the failure detection section 20. If it is determined that the failure detection section 20 has detected the failure of any of the LEDs 41, the control section 21 terminates the processing, because if this processing were continued, a defective printed material would be produced.

Meanwhile, if the failure of the LEDs 41 is not detected at the step S16 or S18, the processing proceeds to a step S19. Then, the control section 21 performs determinations and operations at steps S19 to S23 that are the same as those in the steps S3 to S7 shown in FIG. 4. If it is determined that no substrate 11 or image 13 to be printed remains at the step S21 or S23, the control section 21 terminates the recording.

On the other hand, if the failure of the LEDs 41 is not detected at the step S14, the processing proceeds to the step S1 shown in FIG. 4, and the control section 21 performs the operation in the normal mode.

The ink jet printer 1 of the embodiment that has the above-configured structure prevents the occurrence of situations where useless printed materials having no commercial value are produced as a result from the failure of the LEDs 41, and the ultraviolet (UV) curable inks are wasted. This effect is significant, especially when the ink jet printer 1 operates automatically.

In addition, the recording apparatus 1 prevents the occurrence of a trouble in which uncured ultraviolet (UV) curable inks that stay in the interior and are adhered to any members or the like deteriorate the performance.

Detailed Operation in Failure Event Mode (Refer to FIGS. 6A to 6C and FIGS. 7A to 7D)

FIGS. 6A to 6C depict an example of the band feeding recording, and schematically illustrate the recorded state generated by an operation in the normal mode, which is performed when none of the LEDs 41 fails. In this example, band feedings for one to three passes are illustrated for the purpose of clarifying a relationship between the respective band feedings and eight nozzle openings 7.

When the recording head executes recording for the first pass, all the nozzle openings (or first to eighth nozzle openings) 7 discharge photoactive liquids (refer to FIG. 6A). Subsequently, the transportation mechanism 3 carries out band feeding by a band feeding amount D, and then, the recording head executes recording for the second pass (refer to FIG. 6B). Finally, the transportation mechanism 3 carries out band feeding by the band feeding amount D, and then, the recording head executes recording for the third pass (refer to FIG. 6C).

FIGS. 7A to 7D depict another example of band feeding recording, and schematically illustrate the recording state generated by an operation in the failure event mode that is performed when at least one of the LEDs 41 fails. In this example, band feedings for one to four passes are illustrated for the purpose of clarifying a relationship between the respective band feedings and eight nozzle openings 7. In addition, in the example, the nozzles 7 of Nos. 3 and 4 are masked as a result from the failure of one or more of the LEDs 41.

Upon the recording operation for the first pass, photoactive liquids are not discharged onto positions that correspond to the masked nozzle openings 7 (of Nos. 3 and 4) (refer to FIG. 7A). Then, the transportation mechanism 3 does not carry out band feeding by the band feeding amount D. Instead, the transportation mechanism 3 carries out band feeding by an amount necessary for the nozzle openings 7 of Nos. 1 and 2 to be disposed at the respective positions where photoactive liquids are not discharged. Subsequently, the recording head executes recording for the second pass (refer to FIGS. 7B). This recording for the second pass is executed while the nozzle openings 7 of Nos. 3 to 6 are masked. This prevents the deficiency of the discharged photoactive liquids, as shown in FIG. 7B. Note that in FIG. 7B, the photoactive liquids discharged upon recording for the first and second passes are slightly shifted from one another, for the purpose of easily discriminating between respective liquids discharged for the first and second passes. This is also applied to FIG. 7D described later.

Then, the transportation mechanism 3 carries out band feeding by the band feeding amount D, and the recording heads executes recording for the third pass (refer to FIG. 7C). Similar to the printed state shown in FIG. 7A, photoactive liquids are not discharged onto positions that correspond to the masked nozzle openings 7 (of Nos. 3 and 4) (refer to FIG. 7C). Finally, the transportation mechanism 3 carries out band feeding and the recording head executes recording in the same way as that shown in FIG. 7B, thereby also preventing the deficiency of the discharged photoactive liquids (refer to FIG. 7D).

Thereafter, the same processing is repeated, so that recording is executed without causing the deficiency of photoactive liquids.

The above description has been given, in the case where the nozzle openings 7 of Nos. 3 and 4 are masked as a result from the failure of the LEDs 41. However, this description can also be applied to a case where nozzle openings of other numbers are masked.

Moreover, in the example shown in FIG. 7A to 7D, only the nozzle openings of Nos. 5 to 8, namely, only ones at the ends of the nozzle rows 5W, 5C, 5M, 5Y and 5K are used to perform the recording operation, for the purpose of simplifying the band feeding.

FIGS. 6A to 6C and FIGS. 7A to 7D show the examples in which the recording apparatus 1 according to the embodiment of the present invention is applied to a recording apparatus for the band feeding recording. However, the recording apparatus 1 may also be applied to a recording apparatus for high resolution recording. The term "high resolution recording" refers to a method of recording images or the like in a resolution that is as fine as or finer than the interval of the nozzle openings 7. Examples of this method include known microwave recording, and normal high resolution recording that repeats small amount feeding and large amount feeding.

Another Embodiment

The recording apparatus 1 according to the embodiment of the invention basically has the above-described structure. However, it is obvious that various partial modifications to the structure or omissions thereof be possible without departing from the spirit of the invention of this application.

For example, the control section 21 may include an alternate recording mode in advance, in which the recording method that has been used prior to the occurrence of the failure can be continued to be used by using all or some of the unmasked nozzle openings 7, when at least one of the light emitting device 41 fails and some of the nozzle openings 7 that correspond to the failed light emitting device 41 are masked. Consequently, the recording operation can go into the failure event mode immediately after any of the light emitting devices 41 fails, and then, continue the recording operation.

Although each of the light irradiation sections 19A and 19B has the three light emitting device rows 39A, 39B and 39C in this embodiment, the number of light emitting device rows is not limited to three. Alternatively, two or more than three light emitting device rows may be provided.

If the ink jet printer 1 is an exclusive printer for the images 13, the ink jet printer 1 may be provided with only the second recording head 15B for forming images, and a pair of irradiation sections 19B may be provided close to and on the respective sides of the second recording head 15B in the direction B.

In this case, the control section 21 does not need to turn on/off the second recording head 15B and the second light irradiation sections 19B, depending on whether the moving direction of the carriage 17 is forward or reverse. This makes it easy for the control section 21 to control the operation of the recording head and the light irradiation section.

The light irradiation intensity of the LEDs 41 may be adjusted individually, depending on whether the operation mode is the normal mode 43 or the failure event mode 45. In addition, the light irradiation intensity of an LED 41 that makes up for a failed LED may be adjusted depending on the position of the failed LED. Furthermore, the light irradiation intensity of each LED 41 may be adjusted, depending on a distance between the recording head unit 15 and the light emitting device row where this LED 41 is disposed.

The photoactive liquids C1 and C2 discharged from the recording head unit 15 are not limited to ultraviolet (UV) curable inks. Alternatively, various photoactive liquids that are to be chemically changed by being exposed to the irradiation of a light ray of a certain wavelength other than ultraviolet ray (UV light) may be employed. In addition, the light emitting devices 41 may not be LEDs. Specifically, any photoactive liquid, the color of which is to be changed by being exposed to the irradiation of a light ray of a certain wavelength, may be applied to the ink jet printer 1 according to the embodiments of the invention which is configured to form the images 13 on the recording surface 9 of the recording material P.

The entire disclosure of Japanese Patent Application No. 2011-087542, filed on Apr. 11, 2011 is expressly incorporated by reference herein.

What is claimed is:

1. A recording apparatus comprising:

a transportation mechanism that transports a recording material;

a recording head that reciprocates in a direction intersecting a transporting direction of the recording material, the recording head having a nozzle row discharging photoactive liquids onto the recording material being transported;

a light irradiation section that has a light emitting device row where a plurality of light emitting devices are arranged in an extending direction of the nozzle row, the light emitting devices chemically changing the photoactive liquids by irradiating the discharged photoactive liquids with light;

a failure detection section that detects failure of the light emitting devices constituting the light emitting device row; and a control section that controls respective operations of the transportation mechanism, the recording head, and the light irradiation section, wherein the control section has a failure event mode into which the control section goes when the failure detection section detects failure of at least one of the light emitting devices, and the failure event mode is configured to execute recording by masking at least one of nozzle openings constituting the nozzle row which corresponds to the failed light emitting device.

2. The recording apparatus according to claim 1, wherein the control section changes an amount by which the transportation mechanism feeds the transportation material during a subsequent recording operation, at a location where the photoactive liquids should be discharged from the masked nozzle openings, and the recording is executed while the unmasked nozzle openings and the location are aligned.

3. The recording apparatus according to claim 1 wherein the recording apparatus is configured to execute the recording by means of a recording method employing at least one of band feeding recording and high resolution recording, and wherein the control section is equipped with an alternate recording mode in advance, in which the recording method that has been used prior to an occurrence of the failure is continued to be used by using all or some of the unmasked nozzle openings, while the nozzle opening that corresponds to the failed light emitting device is masked.

4. The recording apparatus according to claim 1, wherein the light emitting device row in the light irradiation section includes a plurality of light emitting device rows.

* * * * *